US006885831B2

(12) United States Patent
Lee

(10) Patent No.: US 6,885,831 B2
(45) Date of Patent: Apr. 26, 2005

(54) DETECTING APPARATUS OF DEVELOPMENT CARTRIDGE USED WITH AN IMAGE FORMING MACHINE

(75) Inventor: Gi-young Lee, Yongin (KR)

(73) Assignee: Samsung Electronics Co., LTD, Suwon-si (KR)

( * ) Notice: Subject to any disclaimer, the term of this patent is extended or adjusted under 35 U.S.C. 154(b) by 0 days.

(21) Appl. No.: 10/456,524

(22) Filed: Jun. 9, 2003

(65) Prior Publication Data

US 2004/0109700 A1 Jun. 10, 2004

(30) Foreign Application Priority Data

Dec. 6, 2002 (KR) ..... 10-2002-0077445

(51) Int. Cl.[7] ..... G03G 15/00
(52) U.S. Cl. ..... 399/13; 399/111; 399/119
(58) Field of Search ..... 399/12, 13, 25, 399/111, 113, 119, 120, 262

(56) References Cited

U.S. PATENT DOCUMENTS 5,311,253 A * 5/1994 Ohmori et al. ..... 399/13
6,298,202 B1 * 10/2001 Fushiya et al. ..... 399/12

* cited by examiner

*Primary Examiner*—Hoang Ngo
(74) *Attorney, Agent, or Firm*—Staas & Halsey LLP

(57) ABSTRACT

A detecting apparatus of a development cartridge used with an image forming machine which can perform a printing process after detecting whether an appropriate development cartridge is mounted. The detecting apparatus includes a pressing portion formed on a lower surface of the development cartridge, an operation member disposed in the guiding portion to unidirectionally pivot by a predetermined angle by the pressing portion when the development cartridge is mounted on the guiding portion, and a sensor operating when the operation member pivots by a predetermined angle, wherein the detecting apparatus recognizes that the development cartridge is mounted when the sensor operates. The operation member includes a detecting portion pressed by the pressing portion, and a rotation shaft to support the detecting portion to pivot by a predetermined angle, and the sensor is operated by the detecting portion. A sensing portion protruding from the rotation shaft having a predetermined distance from the detecting portion is further disposed and the sensor is operated by the sensing portion.

17 Claims, 6 Drawing Sheets

DETECTING APPARATUS OF DEVELOPMENT CARTRIDGE USED WITH AN IMAGE FORMING MACHINE

CROSS-REFERENCE TO RELATED APPLICATIONS

This application claims the benefit of Korean Application No. 2002-77445, filed Dec. 6, 2002, in the Korean Intellectual Property Office, the disclosure of which is incorporated herein by reference.

BACKGROUND OF THE INVENTION

1. Field of the Invention

The present invention relates to an electrophotographic image forming machine such as a laser printer, a facsimile machine and a copier, and more particularly, to a detecting apparatus of a development cartridge used with an image forming machine capable of detecting the presence of the development cartridge mounted in the image forming machine.

2. Description of the Related Art

Generally, an image forming apparatus uses a development cartridge with a photosensitive drum and a development roller integrally mounted in a housing as a unit that can be easily mounted and/or dismounted to and/or from the body.

Such development cartridges have the same structural elements, i.e., a housing, but occasionally vary in the functional elements such as a developing agent and interior functional parts, and the shape or size of the parts mounted in the body. If the development cartridge and the body of the image forming machine are not suitable for each other, the printing quality may be deteriorated, or the image forming machine itself may break down. Accordingly, it is necessary to use an appropriate development cartridge suitable to be used in the image forming machine.

A conventional detecting apparatus of a development cartridge used with an image forming machine is shown in FIG. 1. Referring to FIG. 1, the detecting apparatus of a development cartridge comprises a cartridge detecting key 12 and a cartridge detecting groove 22. The cartridge detecting key 12 is disposed in the image forming machine body 10 and protrudes towards a development cartridge guiding portion. The cartridge detecting groove 22 is a groove formed on a development cartridge 20 in a shape and a size suitable for the cartridge detecting key 12 to be inserted when the development cartridge 20 is completely inserted into the guiding portion of the image forming body 10. Accordingly, when an appropriate development cartridge 20 is inserted in the image forming machine body 10, it can be completely mounted as the cartridge detecting key 12 is inserted into the cartridge detecting groove 22. However, if an inappropriate development cartridge 20 is inserted, the development cartridge 20 cannot be mounted completely since the cartridge detecting key 12 is interrupted by a part other than the cartridge detecting groove 22. Therefore, the use of an inappropriate development cartridge can be prevented.

However, such a detecting apparatus of a development cartridge having a simple mechanical structure allows the use of an inappropriate development cartridge by a simple operation such as removing or modifying the cartridge detecting key.

Accordingly, there is a need for a detecting apparatus of a development cartridge that enables the image forming machine to operate only when an appropriate development cartridge is mounted and prevents an inappropriate development cartridge from being used by a user's simple operation.

SUMMARY OF THE INVENTION

Accordingly, it is an object of the present invention to provide a detecting apparatus of a development cartridge used with an image forming machine which can easily detect whether the development cartridge is mounted in the image forming machine body and also disable the use of an inappropriate development cartridge by a simple operation.

Additional aspects and advantages of the invention will be set forth in part in the description which follows and, in part, will be obvious from the description, or may be learned by practice of the invention.

The foregoing and/or other objects and advantages of the present invention are realized by providing a detecting apparatus of a development cartridge used with an image forming machine to detect whether the development cartridge is mounted on a guiding portion along which a paper is conveyed, the detecting apparatus comprising a pressing portion formed on a lower surface of the development cartridge, an operation member disposed in the guiding portion to unidirectionally pivot at a predetermined angle by the pressing portion when the development cartridge is mounted on the guiding portion, and a sensor operating when the operation member pivots by a predetermined angle, wherein the detecting apparatus recognizes that the development cartridge is mounted when the sensor operates.

The operation member comprises a detecting portion pressed by the pressing portion, and a rotation shaft to support the detecting portion to pivot at a predetermined angle, and the sensor is operated by the detecting portion.

A sensing portion protruding from the rotation shaft having a predetermined distance from the detecting portion is further disposed and the sensor is operated by the sensing portion.

The foregoing and/or other aspects of the present invention are also achieved by providing a detecting apparatus of a development cartridge used with an image forming machine to detect whether the development cartridge is mounted on a guiding portion along which a paper is conveyed, the detecting apparatus comprising a detecting hole formed on the guiding portion, an operation member comprising a rotation shaft disposed on a lower surface of the guiding portion, a detecting portion protruding from the rotation shaft having a part of the detecting portion protruding through the detecting hole, and a sensing portion protruding from the rotation shaft to keep a balance when the detecting portion sticks out of the detecting hole, a sensor operated by the sensing portion, and a pressing portion formed on the development cartridge to press the detecting portion into the detecting hole, wherein the detecting portion pivots downward by the pressing portion when the development cartridge is mounted on the guiding portion, and the sensing portion operates the sensor when the detecting portion pivots.

It is an aspect of the invention that the detecting hole is formed to be plural in number, the detecting portion of the operation member being formed to move in an axial direction relative to the rotation shaft and be fastened on a position to correspond to the detecting hole, and a position of the detecting portion can be adjusted according to a position of the pressing portion of the development cartridge. The detecting apparatus of a development cartridge used with an image forming machine according to the present invention described above can easily detect whether the development cartridge is mounted in the image forming machine body and disable the use of an inappropriate development cartridge by a simple operation.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DESCRIPTION OF THE PREFERRED EMBODIMENTS

Figure 1:
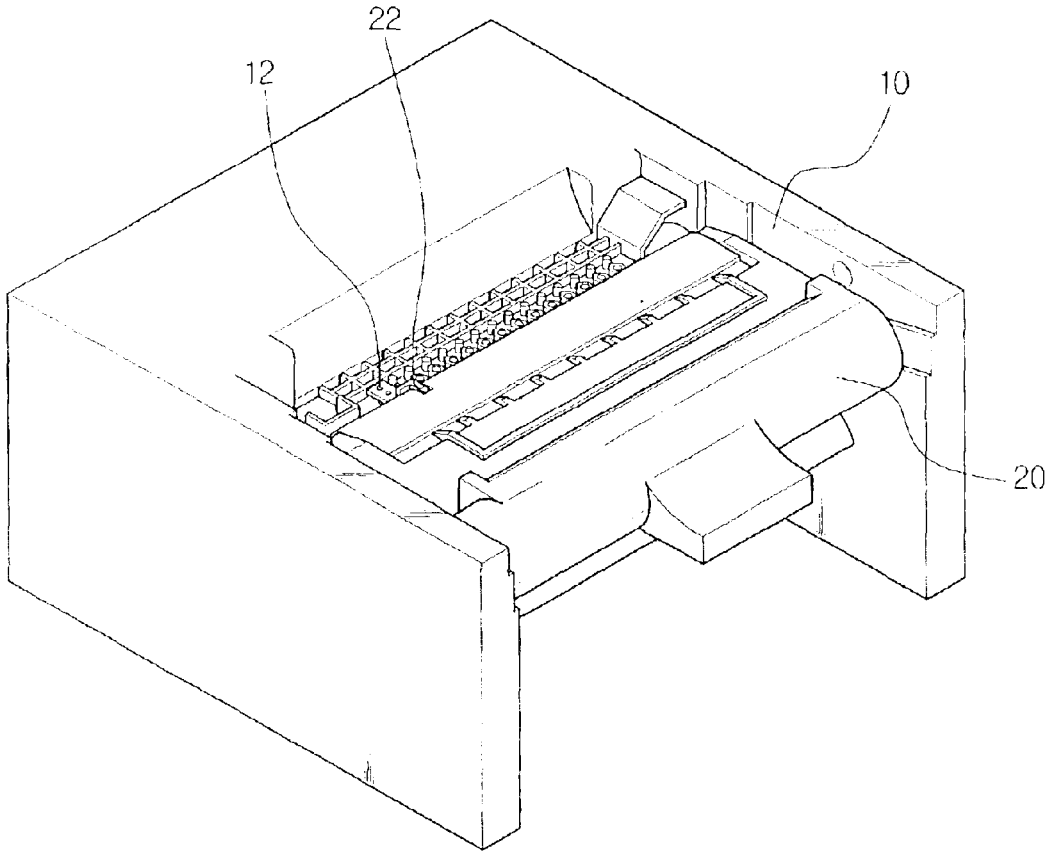
FIG. 1 (PRIOR ART)
FIG. 1 is a perspective view showing a conventional detecting apparatus of a development cartridge used with an image forming machine.
Figure 2:
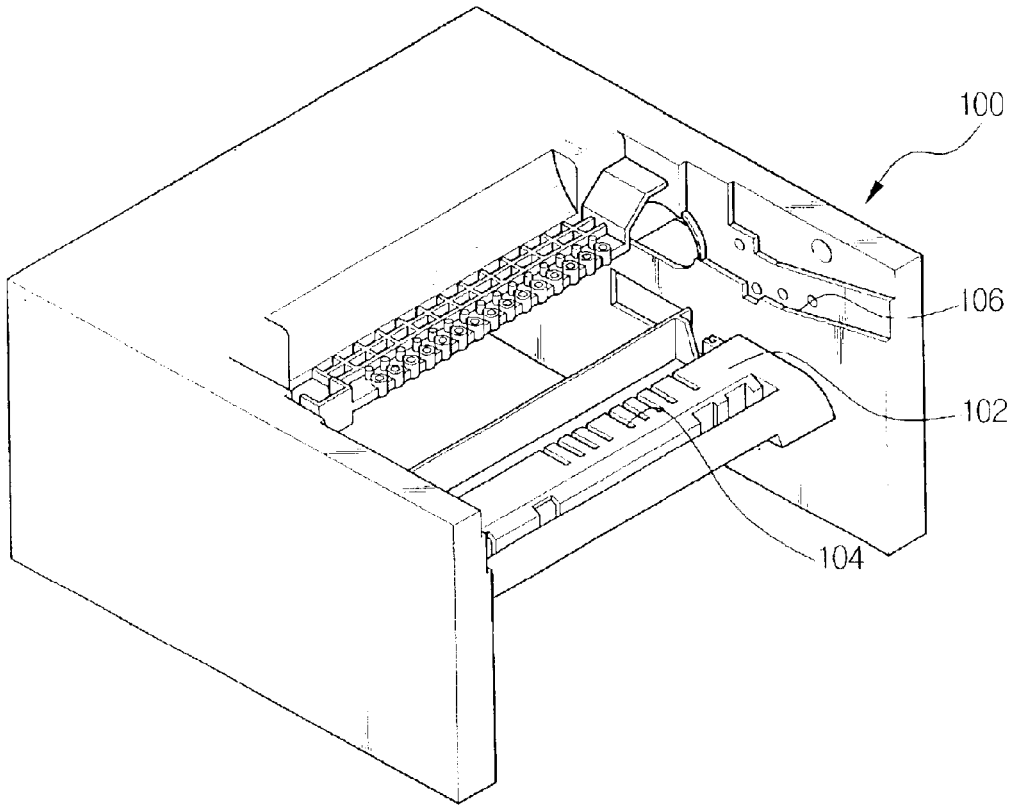
FIG. 2 is a perspective view showing a guiding portion with a detecting hole of a detecting apparatus of a development cartridge of an image forming machine according to an embodiment of the present invention.
Figure 3:
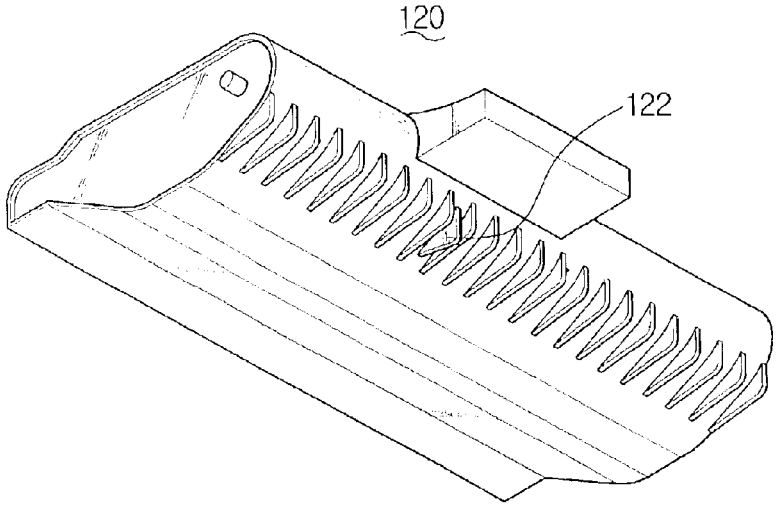
FIG. 3 is a perspective view showing a development cartridge having a pressing portion of a detecting apparatus used with an image forming machine according to an embodiment of the present invention.
Figure 4:
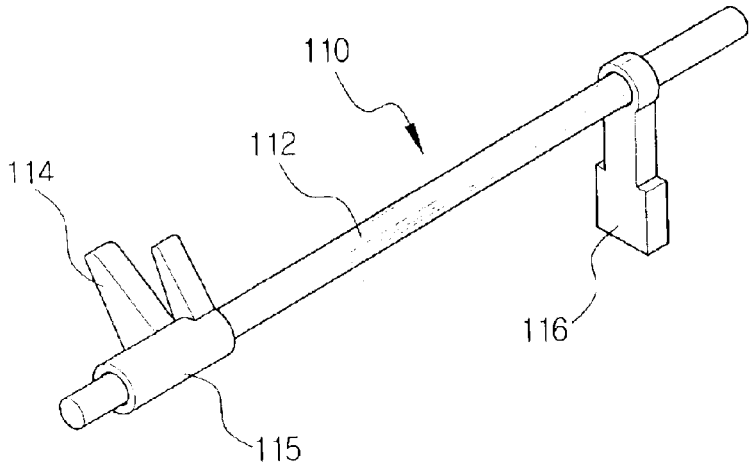
FIG. 4 is a perspective view showing an operation member of a detecting apparatus of a development cartridge used with an image forming machine according to an embodiment of the present invention.

Reference will now made in detail to the present preferred embodiments of the present invention, examples of which are illustrated in the accompanying drawings, wherein like reference numerals refer to the like elements throughout. The embodiments are described below in order to explain the present invention by referring to the figures.

Referring to FIGS. 2 through 6, the detecting apparatus of a development cartridge used with an image forming machine according to an embodiment of the present invention comprises a detecting hole 104, an operation member 110, a sensor 130, and a pressing portion 122.

The detecting hole 104 is formed on a guiding portion 102 of an image forming machine body 100 to receive the pressing portion 122 of a development cartridge 120 which will be described later. If there are many types of development cartridges 120 that can be used with a single model of an image forming machine, the image forming machine can use all of those types of development cartridges 120 by providing a plurality of detecting holes 104 and allowing each pressing portion 122 of the development cartridge 120 to be placed respectively into the detecting holes 104. The guiding portion 102 according to this embodiment is a part provided on the image forming machine body 100 to form a paper convey route together with the lower surface of the development cartridge 120 to allow a sheet of paper to be conveyed through, and mounting portions 106 onto which a development cartridge is mounted are formed on both sides of the guiding portion 102.

Figure 6A:
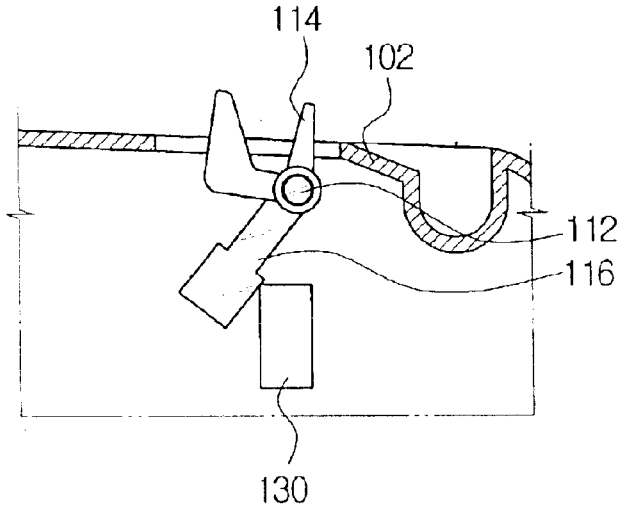
FIG. 6A is a partial section view showing an operation member and a sensor of a detecting apparatus of a development cartridge used with an image forming machine of FIG. 5.

The operation member 110 comprises a rotation shaft 112, a detecting portion 114, and a sensing portion 116. The rotation shaft 112 is rotatably disposed below the guiding portion 102 in which a detecting hole 104 is formed. In addition, the rotation shaft 112 is formed in length to correspond with all detecting holes 104 when there is a plurality of detecting holes 104 described above. The detecting portion 114 is disposed on the rotation shaft 112, and has one end provided with a boss 115 to assemble the detecting portion 114 on the rotation shaft 112, and the other end formed to freely move through the detecting hole 104. Additionally, the other end of the detecting portion 114 is formed in a shape so as to make it easy to be pressed by the pressing portion 122 of the development cartridge 120. Therefore, the detecting portion 114 can be located in a predetermined position in an axial direction with respect to the rotation shaft 112, and is fastened on the rotation shaft 112 by a fastening member such as a set screw. The sensing portion 116 protrudes from the rotation shaft having a predetermined distance from the detecting portion 114 and is formed in a shape so as to operate the sensor 130. When no force is applied to the detecting portion 114, the detecting portion 114 keeps the balance of weight between itself and the sensing portion 116 while protruding upward through the detecting hole 104, and the sensing portion 116 should be positioned outside the sensing area. That is, as shown in FIG. 6A, when the development cartridge 120 is not positioned on the guiding portion 102, in other words, when the development cartridge 120 is not mounted in the mounting portions 106, the detecting portion 114 sticks out of the detecting hole 104 while the sensing portion 116 is located in a position not operating the sensor 130. The sensing portion 116 is formed to cause the sensor 130 to be on when the development cartridge 120 is mounted in the mounting portion 106, whereby the detecting portion 114 is pressed downward by the pressing portion 122.

In addition, when the sensing portion 116 and the sensor 130 are used as paper detecting apparatuses to detect whether paper is fed from a feed apparatus 141 (FIG. 8), the sensor portion 116 needs to be formed to escape from the detecting area of the sensor 130 such that the sensor 130 is off as the paper passes through the paper convey route 143 (FIG. 8) pivoting the detecting portion 114 further downward.

Figure 7:
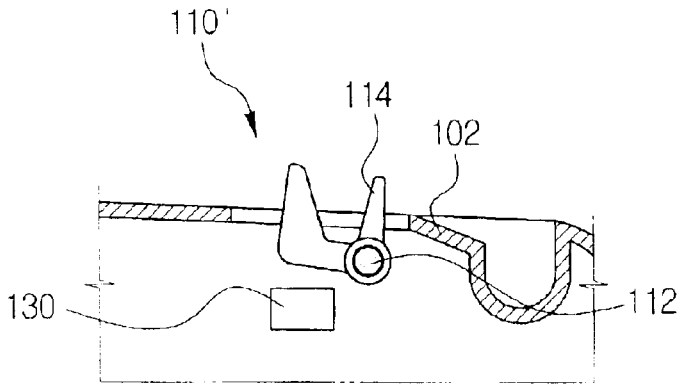
FIG. 7 is a partial section view showing a detecting portion operating a sensor according to another embodiment of a detecting apparatus of a development cartridge used with an image forming machine.

The operation member 110' according to another embodiment may have the sensor 130 sense whether the development cartridge 120 is mounted by detecting the operation of the detecting portion 114 without separately having a sensing portion 116, as shown in FIG. 7. Meanwhile, in such a case, the mounting position of the operation member 110' and the sensor 130 need to be adjusted to correspond to the pressing portion 122 of each development cartridge 120 when a single image forming machine 100 uses many types of development cartridges. In other words, in order to use a new development cartridge different from a previously used development cartridge 120, the operation member 110' and the sensor 130 disposed in the guiding portion 102 need to be moved to correspond to the pressing portion 122 of the new development cartridge.

When the development cartridge 120 is mounted and the operation member 110 is operated, the sensor 130 detects the operation and transmits a signal that the development cartridge 120 is mounted to a controller (not shown) of an image forming machine 100, thereby allowing the controller to operate a printing process. The sensor 130 may use any type of sensor provided that it can be operated by the sensing portion 116, but it is preferable to use a photo sensor which is on when the sensing portion 116 enters the detecting area and off when the sensing portion 116 escapes from the detecting area. The sensor 130 is disposed to be in a position where it can detect the sensing portion 116 when the operation member 110 pivots downward as the detecting portion 114 is pressed by the pressing portion 122.

The pressing portion 122 is formed to be in a position corresponding to the detecting hole 104 of the guiding portion 102 below the development cartridge 120. The pressing portion 122 is formed to operate the sensor 130 by pressing the detecting portion 114, protruding from the detecting hole 104, when the development cartridge 120 is completely mounted in the mounting portion 106. When the development cartridge 120 is completely mounted in the mounting portion 106, the bottom of the development cartridge 120 and the guiding portion 102 form a paper convey route 143 (FIG. 8) through which a sheet of paper picked up from the feed apparatus 141 (FIG. 8) is conveyed. Thus, the pressing portion 122 is formed to pivot the detecting portion 114 of the operation member 110 without blocking the paper convey route 143. In addition, when the development cartridge 120 is produced by many manufacturers, the manufacturer of the development cartridge 120 can be distinguished by the position of the pressing portion 122 varied by a manufacturer.

Hereinafter, the operation of the detecting apparatus of a development cartridge used with an image forming machine according to an embodiment of the present invention having the above described structure will be described while referring to FIGS. 5 through 9.

Figure 5:
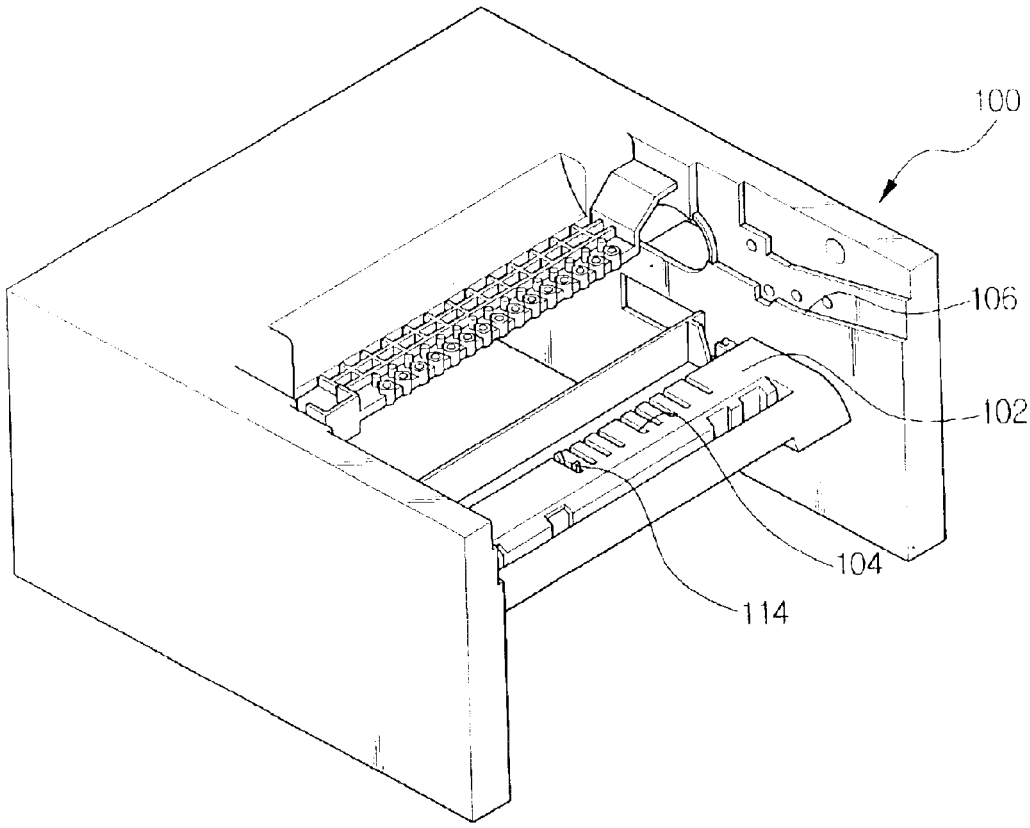
FIG. 5 is a perspective view showing a detecting apparatus of a development cartridge used with an image forming machine according to an embodiment of the present invention when a development cartridge is not mounted.

FIG. 5 shows the guiding portion 102 and the mounting portion 106 of an image forming machine before the development cartridge 120 is mounted. Referring to the drawing, a part of the detecting portion 114 sticks out of the detecting hole 104. At this time, the sensing portion 116 is located outside the detecting area of the sensor 130 and the sensor 130 is in the off state, as shown in FIG. 6A. When the sensor 130 is off, the controller (not shown) of an image forming machine does not carry out any printing processes recognizing that the development cartridge 120 is not mounted.

Figure 6B:
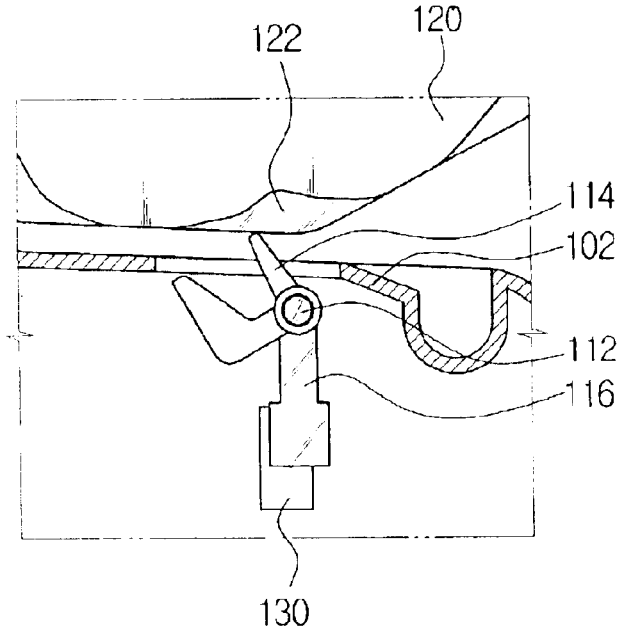
FIG. 6B is a partial section view showing an operation member and a sensor when a development cartridge is mounted in the image forming machine of FIG. 5.

If an appropriate development cartridge 120 is mounted in the mounting portion 106 of an image forming machine 100, the bottom of the development cartridge 120 and the guiding portion 102 form a paper convey route, and the pressing portion 122 presses the detecting portion 114 allowing the operation member 110 to pivot at a predetermined angle. At this time, if the development cartridge 120 is not appropriate for the image forming machine 100, the pressing portion 122 can not press the detecting portion 114 since the position of the pressing portion 122 of the development cartridge 120 is different from the position of the detecting portion 114 formed on the guiding portion 102. When the pressing portion 122 presses the detecting portion 114 as shown in FIG. 6B, the operation member 110 pivots, thereby allowing the sensing portion 116 to enter the detecting area of the sensor 130. When the sensing portion 116 enters the detecting area of the sensor 130, the sensor 130 is turned on. Then, the controller of the image forming machine becomes able to carry out printing processes upon recognizing that the development cartridge 120 is mounted. Therefore, if the development cartridge 120 mounted in the image forming machine 100 is not appropriate, the sensor 130 does not work, and therefore the controller does not carry out any printing processes upon recognizing that the development cartridge 120 is not mounted.

If the development cartridge 120 is dismounted from the mounting portion 106 in order to change the development cartridge 120, the pressing portion 122 of the development cartridge 120 is separated from the detecting portion 114 of the operation member 110. Then, the detecting portion 114 of the operation member 110 sticks out of the detecting hole 104 by the weight balance, and the sensing portion 116 escapes from the detecting area of the sensor 130. (FIG. 6A) If the sensing portion 116 escapes from the detecting area 130 of the sensor 130, the sensor 130 is turned off and the controller recognizes that the developing cartridge 120 is not mounted.

Hereinafter, described is a method of mounting only a particular development cartridge 120 to a particular image forming machine when a same image forming machine can have many different types of development cartridges mounted in its guiding portion 102. First of all, the pressing portion's 122 position of a particular type of a development cartridge is formed to correspond to one of the plurality of detecting holes 104 formed on the guiding portion 102. An operation member 110, with a detecting portion 114 adjusted to protrude through the detecting hole 104 corresponding to the pressing portion 122 of the corresponding development cartridge, is then disposed within the image forming machine which will be using that particular development cartridge. The detecting portion 114 can be simply adjusted by releasing a fastening member of a boss 115 of the detecting portion 114, then moving the detecting portion 114 in a rotation shaft 112 length direction to correspond to the detecting hole 104, and fastening the fastening member. In case of the image forming machine having another type of development cartridge mounted, the development cartridge can be appropriately used by forming a pressing portion 122 in a position different from the position on which the pressing portion 122 of the previously used development cartridge 120 was formed and allowing the detecting portion 114 of an operation member 110 to protrude through the detecting hole 104 corresponding to the position where the pressing portion 122 is formed. Therefore, it is possible to use a same guiding portion 102 for as many types of development cartridge 120 as the number of detecting holes 104 formed on the guiding portion 102 and also detect whether each development cartridge 120 is mounted or not.

Hereinafter, the operation of detecting paper, in case an operation member 110 and a sensor 130 are also used as paper detecting apparatuses detecting whether paper is conveyed, will be described.

Figure 8:
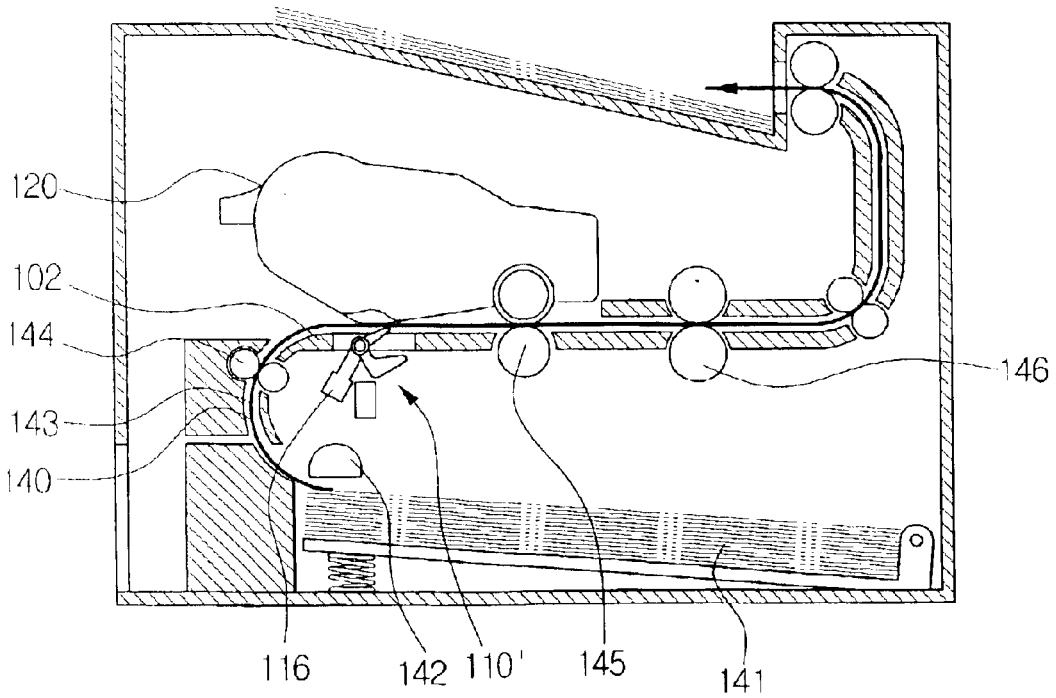
FIG. 8 is a section view schematically showing a structure of an image forming machine having a detecting apparatus of a development cartridge used with an image forming machine according to FIG. 7.
Figure 9:
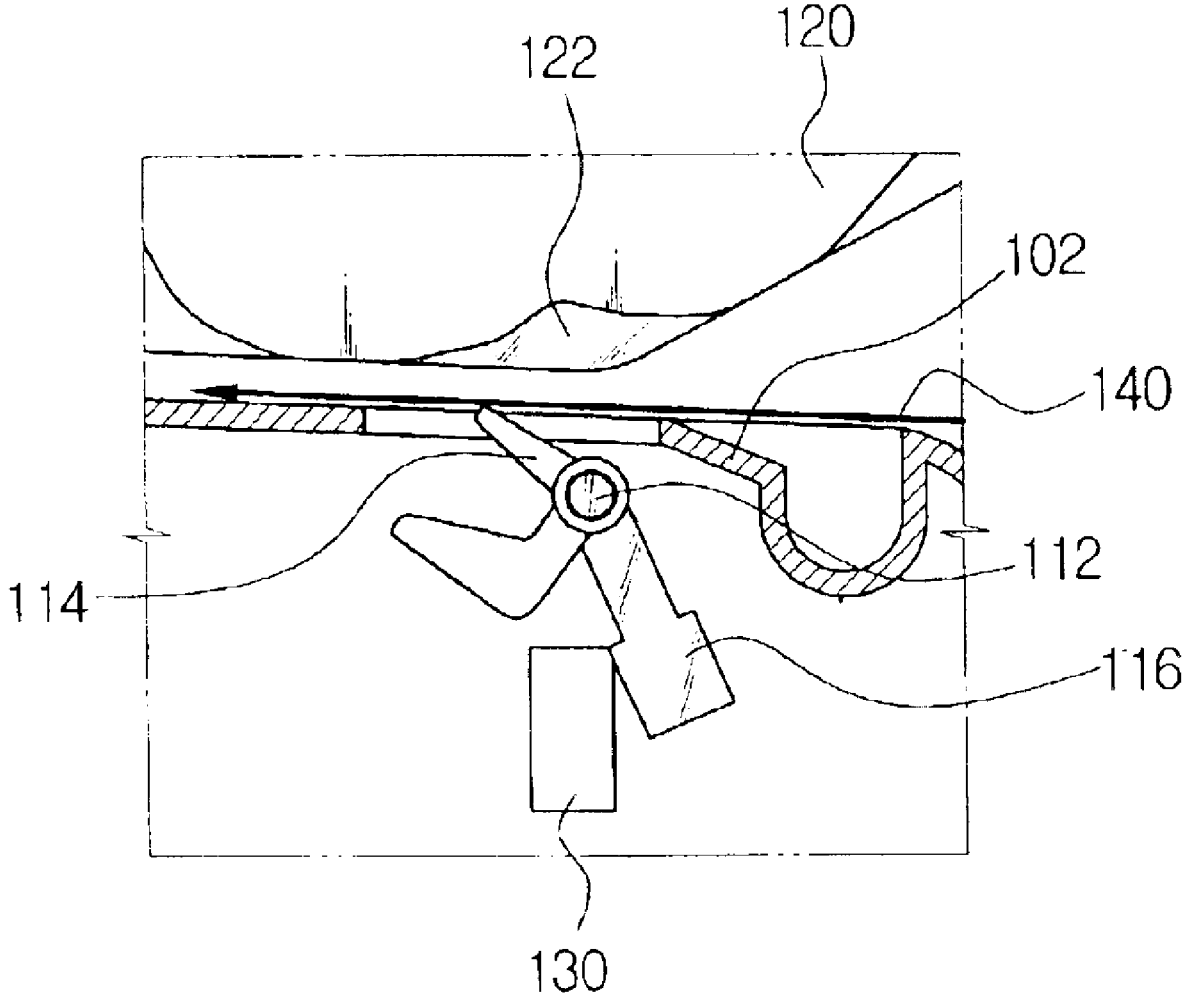
FIG. 9 is a partial section view showing an operation member and a sensor when a sheet of paper passes the detecting apparatus of a development cartridge of FIG. 8.

The operation member 110 is disposed in a paper convey route 143 formed by a guiding portion 102 and the bottom of a development cartridge 120 as shown in FIG. 8. Paper 140 picked up by a feed apparatus 141 is conveyed along the paper convey path 143 towards a transfer roller 145 pressing a detecting portion 114 of the operation member 110 further downward. At this time, a sensing portion 116 escapes from the detecting area of the sensor 130 whereby the sensor 130 is turned off. If the rear end of the paper 140 is freed from interference of the detecting portion 114, the sensing portion 116 pivots downward by its own weight reentering into the sensing area of the sensor 130 thereby turning the sensor 130 on. A controller can recognize whether the paper 140 is conveyed by the operation of the sensor 130 turning on again after staying off for a predetermined period of time. In FIG. 8, reference numbers 142, 144, and 146 which were not described previously are a pickup roller, a feed roller and a fixing roller respectively.

As described above, the detecting apparatus of a development cartridge for an image forming machine according to the present invention is able to easily detect whether the development cartridge is mounted, and prevent another development cartridge from being used by a user's simple operation as the operation member is disposed under the guiding portion. Additionally, the operation member can be used as a paper detecting apparatus to detect whether the picked up paper is conveyed.

The foregoing embodiments and advantages are merely exemplary and are not to be construed as limiting the present invention. The present teaching can be readily applied to other types of apparatuses. The description of the present invention is intended to be illustrative, and not to limit the scope of the claims.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A detecting apparatus of a development cartridge used with an image forming machine to detect whether the development cartridge is mounted on a guiding portion along which paper is conveyed, the detecting apparatus comprising:

a pressing portion formed on a lower surface of the development cartridge;

an operation member disposed an the guiding portion to unidirectionally pivot by a predetermined angle by the pressing portion when the development cartridge is mounted on the guiding portion; the operation member including a detecting portion pressed by the pressing portion and a rotation shaft to support the detecting portion to pivot by the predetermined angle;

a sensing portion protruding from the rotation shaft and spaced along the rotation shaft from the detecting portion; and a sensor operating when the operation member pivots by a predetermined angle, wherein the detecting apparatus recognizes that the development cartridge is mounted when the sensor operates.

2. The detecting apparatus of the development cartridge used with the image forming machine according to claim 1, wherein the sensor is operated by the detecting portion.

3. The detecting apparatus of the development cartridge used with the image forming machine according to claim 1, wherein the sensor is operated by the sensing portion.

4. The detecting apparatus of the development cartridge used with the image forming machine according to claim 1, wherein the sensor is a photo sensor.

5. A detecting apparatus of a development cartridge used with an image forming machine to detect whether the development cartridge is mounted on a guiding portion along which paper is conveyed, the detecting apparatus comprising:

a detecting hole formed on the guiding portion;

an operation member comprising a rotation shaft disposed on lower surface of the guiding portion, a detecting portion protruding from the rotation shaft having a part of the detecting portion protruding through the detecting hole, and a sensing portion protruding from the rotation shaft to keep a balance when the detecting portion sticks out of the detecting hole;

a sensor operated by the sensing portion; and a pressing portion formed on the development cartridge to press the detecting portion into the detecting hole, wherein the detecting portion pivots downward by the pressing portion when the development cartridge is mounted on the guiding portion, and the sensing portion operates the sensor when the detecting portion pivots.

6. The detecting apparatus of the development cartridge used with the image forming machine according to claim 5, wherein there are a plural number of detecting holes.

7. The detecting apparatus of the development cartridge used with the image forming machine according to claim 6, wherein the detecting portion of the operation member moves in an axial direction relative to the rotation shaft and fastened at a position to correspond to the plural detecting holes, and a position of the detecting portion is adjusted according to a position of the pressing portion of the development cartridge.

8. The detecting apparatus of the development cartridge used with the image forming machine according to claim 5, wherein the sensor is a photo sensor.

9. An image forming machine comprising the detecting apparatus of the development cartridge to detect whether the development cartridge, together with a guiding portion forming a paper convey route, is mounted, the image forming machine comprising:

a detecting hole formed on the guiding portion;

an operation member comprising a rotation shaft disposed on lower surface of the guiding portion, a detecting portion protruding from the rotation shaft having a part of the detecting portion protruding through the detecting hole, and a sensing portion protruding from the rotation shaft to keep a balance when the detecting portion sticks out of the detecting hole;

a sensor operated by the sensing portion; and a pressing portion formed on the development cartridge to press the detecting portion into the detecting hole, wherein the detecting portion pivots downward by the pressing portion and thus the sensing portion turns the sensor on when the development cartridge is mounted on the guiding portion.

10. The image forming machine according to claim 9, wherein the sensing portion turns the sensor off when the development cartridge is mounted and paper passes through the paper convey route, thereby pivoting the detecting portion further downward.

11. The image forming machine according to claim 10, wherein there are plural detecting holes.

12. The image forming machine according to claim 11, wherein the detecting portion of the operation member is formed to move in an axial direction relative to the rotation shaft and be fastened on a position to correspond to the plural detecting holes, and a position of the detecting portion can be adjusted according to a position of the pressing portion of the development cartridge.

13. A development cartridge detecting apparatus of an image forming unit to detect whether the development cartridge is properly mounted therein, the detecting apparatus comprising:

a pressing portion formed on a lower surface of the development cartridge;

an operation member disposed in the image forming machine to pivot by a predetermined degree by the pressing portion when the development cartridge is properly mounted in the image forming machine, the operation member including a detecting portion pressed by the pressing portion and a rotation shaft to support the detecting portion to pivot by the predetermined angle;

a sensing portion protruding from the rotation shaft and spaced along the rotation shaft from the detecting portion; and a sensor in operation when the operation member is pivoted, wherein the detecting apparatus detects that the development cartridge is properly mounted when the sensor is in operation.

14. The development cartridge according to claim 13, wherein the sensor is operated by the detecting portion.

15. The development cartridge according to claim 13, wherein the sensor is operated by the sensing portion.

16. The development cartridge according to claim 13, wherein the sensor is a photo sensor.

17. A development cartridge detecting apparatus of an image forming unit to detect whether the development cartridge is properly mounted therein, the detecting apparatus comprising:

a pressing portion protruding from a lower surface of the development cartridge; and an operation member to determine whether the development cartridge is operable with the image forming unit by making contact with the pressing portion, and upon determining that the development cartridge is operable with the image forming unit, then the operation member sends a signal to begin developing.

* * * * *

UNITED STATES PATENT AND TRADEMARK OFFICE

CERTIFICATE OF CORRECTION

PATENT NO. : 6,885,831 B2
DATED : April 26, 2005
INVENTOR(S) : Gi-young Lee

It is certified that error appears in the above-identified patent and that said Letters Patent is hereby corrected as shown below:

Title page,
Item [54], Title, should read -- DETECTING APPARATUS OF DEVELOPMENT CARTRIDGE FOR IMAGE FORMING MACHINE --.

Column 7,
Line 42, change “an” to -- in --.
Line 45, change “;” to -- , --.
Line 58, indent before “wherein”.

Signed and Sealed this

Tenth Day of January, 2006

JON W. DUDAS
*Director of the United States Patent and Trademark Office*